United States Patent [19]

Masuda

[11] Patent Number: 4,945,900

[45] Date of Patent: Aug. 7, 1990

[54] ROLLER MASSAGING APPARATUS

[75] Inventor: Isamu Masuda, Fukuoka, Japan

[73] Assignee: Nihonkenkozoshinkenkyukai Co., Ltd., Fukuoka, Japan

[21] Appl. No.: 403,217

[22] Filed: Sep. 5, 1989

[51] Int. Cl.[5] ..... A61H 15/00

[52] U.S. Cl. ..... 128/57; 128/60

[58] Field of Search ..... 129/57; 128/60, 61, 128/58

[56] References Cited

U.S. PATENT DOCUMENTS

| | | | |
|---|---|---|---|
| 2,079,096 | 5/1937 | Wilson | 128/57 |
| 2,206,324 | 6/1942 | Wentz | 128/57 |
| 2,461,413 | 2/1949 | Dirand | 128/57 |
| 3,003,497 | 10/1961 | Nunes | 128/57 |
| 3,419,268 | 12/1968 | Bellet | 128/57 |
| 3,616,794 | 11/1971 | Gromala | 128/57 |
| 3,934,579 | 1/1976 | Brodbeck | 128/57 |
| 4,002,163 | 1/1977 | Jackson, Jr. | 128/57 |

*Primary Examiner*—Edgar S. Burr

*Assistant Examiner*—Tonya Lamb

*Attorney, Agent, or Firm*—Jordan and Hamburg

[57] ABSTRACT

The present invention relates to a roller massaging apparatus performing massage by applying pushing pressure on a human body by means of a pushing pressure roller. The pushing pressure roller is supported rotatably on the operating hole of the pushing pressure roller 3 for inserting the operating shaft 2 is formed in an inner diameter large enough for the shaft diameter of the operating shaft 2, and a cavity part provided by the hollow part of the pushing pressure rollers is formed between the operating shaft and the inner peripheral surface of the pushing pressure roller on the operating shaft 2. In such a construction, even if the pushing pressure roller is deformed elastically, this deformation is absorbed by the cavity part, and the rolling operation of the pushing pressure roller 3 is not obstructed. In addition, a soft material giving a comfortable touch with the body can be used for the pushing pressure roller, resulting in an improvement in feeling during use.

9 Claims, 3 Drawing Sheets

ROLLER MASSAGING APPARATUS

BACKGROUND OF THE INVENTION

The present invention relates to a roller massaging apparatus for massaging by applying a pushing pressure on a human body by means of a pushing pressure roller.

One conventional roller massaging apparatus has a construction such that a pushing pressure roller 22 made of rubber is disposed rotatably with a plurality of small protrusions 23 installed on the peripheral surface of the center part of a hollow operating shaft 21, as shown in FIG. 5.

Massage of an affected part using this kind of roller massaging apparatus is performed by a person other than a patient who grips both ends of the operating shaft 21, brings the pushing pressure roller 22 in contact with the back surface or the like of the patient, and thereafter rolls the push pressure roller 22 on the patient's body while applying pushing pressure through the pushing pressure roller 22 on the affected part by applying body weight to both ends of the operating shaft 21. This pushing pressure relaxes the patient's muscles, and push-stimulates the "TSUBO" points (points effective for relief) to improve the health.

In this case, when a soft material is used, for the pushing pressure roller 22, the pushing pressure during the massage operation deforms the pushing pressure roller 22. Accordingly smooth rolling of the pushing pressure roller 22 on the operating shaft 21 is obstructed and the massaging operation is hindered. On the other hand, when a hard material is used for the pushing pressure roller 22, the pushing pressure during the massage operation does not deform the pushing pressure roller 22, and the smooth rolling is not obstructed. However, a problem exists in that due to the stiff and cold touch and lack of cushion of the pushing pressure roller 22, comfortable feeling in use is deteriorated.

The present invention proposes to provide a novel roller massaging apparatus wherein, for example, even if the pushing pressure roller is deformed by pushing pressure, smooth rolling operation is not obstructed, and comfortable feeling in use is realized by good touch and moderate cushion.

SUMMARY OF THE INVENTION

A roller massaging apparatus of the present invention is constructed with an operating shaft having grips at both ends thereof and a pushing pressure roller provided with a hollow hole having an inner diameter large enough for the shaft diameter of a center part of the operating shaft. The operating shaft is inserted into the hollow hole of the pushing pressure roller, and the pushing roller is positioned on the center part of the operating shaft through a cavity part formed by the hollow hole. Bearings are disposed at opening positions of the both ends of the hollow hole of the pushing pressure roller, and the pushing pressure roller is supported rotatably on the operating shaft through these bearings.

In accordance with present invention, the pushing pressure roller is supported on the operating shaft through the bearings, and therefore the rolling action of the pushing pressure roller is smooth. Even if the pushing pressure roller is deformed, this deformation is absorbed by the cavity part. Therefore smooth rolling of the pushing pressure roller is not obstructed, and there is no fear that the massaging operation will be hindered. Also, since a soft material can be used for the pushing pressure roller, body touch is improved, and since a cushion function is given to the pushing pressure roller by the presence of the cavity part, a large improvement in the feel during use can be realized.

DESCRIPTION OF THE PREFERRED EMBODIMENTS

Figure 1:
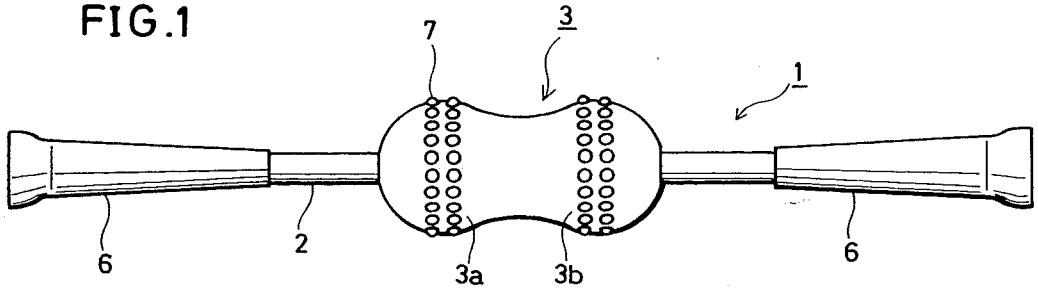
FIG. 1 is a front view showing a roller massaging apparatus of one embodiment in accordance with the present invention.
Figure 5:
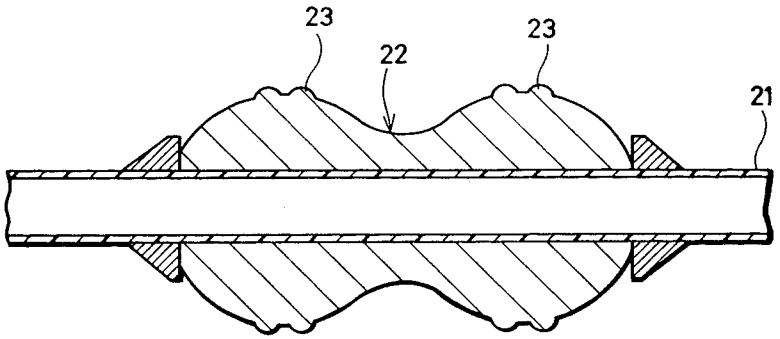
FIG. 5 is a longitudinal cross-sectional view showing a conventional roller massaging apparatus.
Figure 2:
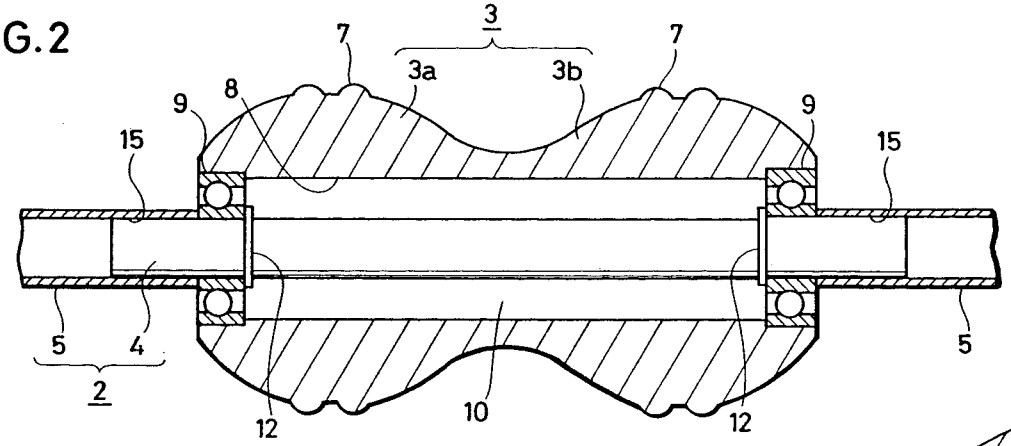
FIG. 2 is a longitudinal cross-sectional view of a pushing pressure roller of the embodiment in FIG. 1.

FIG. 1 and FIG. 2 show one embodiment of a roller massaging apparatus 1 in accordance with the present invention, which is constructed with an operating shaft 2 and a pushing pressure roller 3 made of soft rubber disposed rotatably on the center part of operating shaft 2.

The above-mentioned operating shaft 2 is constructed with a center metal rod 4 and a pair of metal pipes 5 and 5 each provided with a soft-rubber grip 6 at one end thereof. The above-mentioned metal rod 4 is formed slightly longer than the length of the pushing pressure roller 3, and both ends of this metal rod 4 are fitted into inner holes 15 of the metal pipes 5 and 5, respectively, by an appropriate length.

The above-mentioned pushing pressure roller 3 is formed in a shape that a pair of spherical bodies **3*a* and 3*b* are connected integrally, and a plurality of small semi-spherical protrusions 7 are installed integrally in lines on the outer peripheral surface of each of the spherical bodies 3*a* and 3*b*. Inside the pushing pressure roller 3, a hollow hole 8 is installed in a penetrated fashion which has an inner diameter larger than the shaft diameter of the metal rod 4 of the above-mentioned operating shaft 2. The above-mentioned operating shaft 2 is inserted into hollow hole 8, and the pushing pressure roller 3 is positioned on the metal rod 4 of operating shaft 2. Bearings 9 and 9 are tightly fitted into both end opening parts of the hollow hole 8 of the pushing pressure roller 3, and the pushing pressure roller 3 is supported rotatably on the operating shaft 2 through these bearings 9 and 9. A cavity part 10 is formed by the above-mentioned hollow hole 8 between the inner peripheral surface of pushing pressure roller 3 and the operating shaft 2. Cavity part 10 allows the pushing pressure roller 3** to deform.

Figure 3:
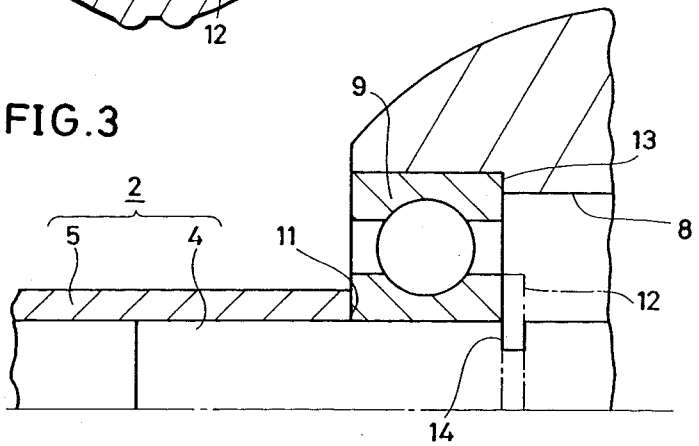
FIG. 3 is a cross-sectional view showing a portion where a bearing is mounted in an enlarged fashion.

FIG. 3 shows a fixed state of the bearing 9 in this embodiment in an enlarged fashion.

In this embodiment, each bearing 9 is disposed at the position of connection of the above-mentioned metal rod 4 and the metal pipe 5. The outside of each bearing 9 is engaged with an end surface 11 of the metal pipe 5, the inside of the bearing 9 is fixed by an annular metal fitting 12 fitted to the metal rod 4, and a stepped part 13 is installed on the inner surface of the hollow hole 8 of the pushing pressure roller 3. In addition, the above-mentioned annular metal fitting 12 is fitted into a peripheral groove 14 installed in the metal rod 4.

Figure 4:
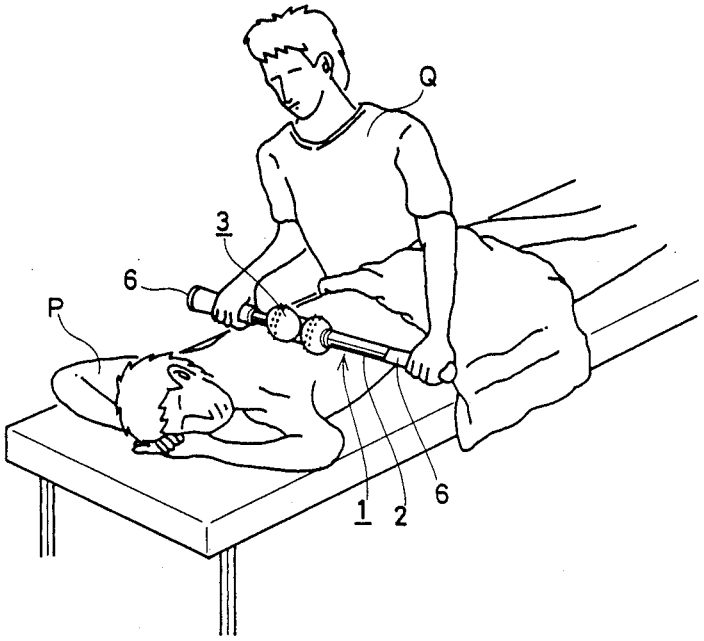
FIG. 4 is an explanatory view showing the roller massaging apparatus in use.

To apply massaging cure to a patient using this roller massaging apparatus, as shown in FIG. 4, a patient P first lies on his stomach. Then a massagist Q grasps the grips 6 and 6 of the operating shaft 2, and brings the pushing pressure roller 3 in contact with the back surface or the like of the patient P. At this time, the small-diameter portion at the center of the pushing pressure roller 3 is positioned just on the backbone, and in this state, the massagist Q rolls the pushing pressure roller 3 along the backbone while applying his body weight to the operating shaft 2 so that the pushing pressure produced by the pushing pressure roller 3 acts on the patient. This pushing pressure relaxes the muscles along the backbone, and effective massage can be performed. Further, the small protrusions 7 on the pushing pressure roller 3 push-stimulate the "TSUBO" points (points effective for relief), and improve the health.

In such a massaging operation, the pushing pressure roller 3 is supported on the operating shaft 2 through the bearings 9 and 9, and therefore the rolling operation of the pushing pressure roller 3 is performed smoothly. Also, even if the pushing pressure roller 3 is deformed elastically, this deformation is absorbed by the inner cavity part 10, and therefore smooth rolling of the pushing pressure roller 3 is not obstructed, and the massaging operation is not hindered. In this case, a soft rubber having a soft touch is used for the pushing pressure roller 3, therefore giving a comfortable touch to the patient's body. The pushing pressure roller 3 is thus given a cushion function by the cavity 10, resulting in a comfortable feeling in use.

In addition, the pushing pressure is transmitted also to the operating shaft 2 through the pushing pressure roller 3, but the center part of the metal rod 4, and therefore the shaft 2, absorbs this pushing pressure and there is no fear of deformation. Also, each bearing 9 is not only fitted tightly into hollow hole 8 of the pushing pressure roller 3, but also held between the end surface 11 of the metal pipe 5 and the annular metal fitting 12, and therefore there is no fear of positional deviation or disassembling. Thus this apparatus excels in durability.

What is claimed is:

1. A massage device comprising a longitudinal operating shaft means having a diameter, a first end, and a second end opposite said first end; a pushing pressure roller means arranged about said operating shaft means for applying localized pressure to a body, said pushing pressure roller means having a first end, a second end, an outer surface and an inner peripheral surface, said inner peripheral surface defining a longitudinal hollow core extending from said first end of said roller means to said second end of said roller means, said hollow core having a diameter of greater size than said diameter of said operating shaft means; first bearing means and second bearing means engaging, respectively, said first and second ends of said roller means with said shaft means for rotatably supporting said roller means about said shaft means, said hollow core forming a cavity between said first and second bearing means wherein said inner peripheral surface of said roller means is arranged in spaced relation to said shaft means, said cavity extending continuously from said first bearing means to said second bearing means; and first and second hand grip means connected, respectively, to said first and second ends of said shaft means.

2. A massage device according to claim 1, wherein said first hand grip means comprises a first metal pipe means having an inner end and a outer end, said inner end being connected to said first end of said shaft means and abutting said first bearing means, and a first grip connected to said outer end; and said second hand grip means comprising a second metal pipe means having an inner end and an outer end, said inner end being connected to said second end of said shaft means and abutting said second bearing means, and a second grip connected to said outer end.

3. A massage device according claim 1, wherein said roller means comprises soft rubber.

4. A massage device according to claim 1, said roller means comprising first and second spherical bodies and a relatively small diameter portion integrally connecting said first and second spherical bodies, said outer surface of said roller means comprising a plurality of small semi-spherical protrusions integrally formed in said first and second spherical bodies.

5. A massage device according to claim 1, wherein said roller means is deformable, said deformation being absorbed by said cavity formed between said first and second bearing means, whereby smooth rolling of the roller means on a body is maintained.

6. A massage device according to claim 1, wherein pressure applied to said roller means is transmitted to said operating shaft means through said bearing means.

7. A massage device according to claim 1, each of said first and second bearing means having an inner surface and an outer surface, said outer surface abutting said hand grip means, said device further including first and second annular metal fitting means fitted about said operating shaft means and engaging the inner surface, respectively, of said first and second bearing means, each bearing means being held in captive engagement between its respective annular metal fitting means and hand grip means.

8. A massage device according to claim 7, wherein said operating shaft means further comprises annular groove means adjacent said first and second bearing means for receiving, respectively, said first and second annular metal fitting means.

9. A massage device according to claim 3, further comprising annular recesses in the inner peripheral surface of said roller means, said annular recesses being formed at the first and second ends of said roller meanss for receiving therein said first and second bearing means.

* * * * *